US006797872B1

(12) United States Patent
Catalano et al.

(10) Patent No.: US 6,797,872 B1
(45) Date of Patent: Sep. 28, 2004

(54) ELECTRONIC TUNER FOR TUNING A MUSICAL INSTRUMENT

(75) Inventors: Carol Rhodes Catalano, Hamilton, MA (US); Aaron Glynn Double, Medford, MA (US); Adam Carr, Allston, MA (US); Maxim Daniel Hurwicz, Stillwater, MN (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 10/404,623

(22) Filed: Apr. 1, 2003

(51) Int. Cl.[7] ..... G10G 7/02
(52) U.S. Cl. ..... 84/454; 84/453
(58) Field of Search ..... 84/453, 454, 387 A, 84/329

(56) References Cited

U.S. PATENT DOCUMENTS

| | | | | |
|---|---|---|---|---|
| 1,697,508 | A | | 1/1929 | Kordick |
| D212,645 | S | | 11/1968 | Garvey |
| 3,437,002 | A | | 4/1969 | Urban et al. |
| 3,691,894 | A | | 12/1972 | Schneider et al. |
| 3,704,646 | A | | 12/1972 | Davis et al. |
| D279,905 | S | | 7/1985 | Whited |
| 4,889,029 | A | | 12/1989 | St. Denis |
| 4,899,636 | A | | 2/1990 | Chiba et al. |
| D353,826 | S | | 12/1994 | Mayo |
| 5,637,820 | A | | 6/1997 | Wittman |
| 5,728,959 | A | | 3/1998 | O'Rorke |
| 5,777,248 | A | | 7/1998 | Campbell |
| 5,990,403 | A | * | 11/1999 | Membreno et al. ..... 84/454 |
| 6,291,755 | B1 | | 9/2001 | Hine et al. |

* cited by examiner

*Primary Examiner*—Jeffrey W Donels
(74) *Attorney, Agent, or Firm*—Gerald T. Bodner

(57) ABSTRACT

An electronic tuner for tuning a musical instrument has a tuner housing in which electronic circuitry for tuning the instrument is situated, and a multi-positional and multi-functional bracket which is reciprocatingly slidable and pivotally mounted on the tuner housing. The bracket is positionable in a closed position, where it rests closely against the tuner housing, as a stand, where it supports the electronic tuner in an upright or a slightly angled position, and in a position where the electronic tuner may be suspended from the musical instrument being tuned.

30 Claims, 8 Drawing Sheets

ELECTRONIC TUNER FOR TUNING A MUSICAL INSTRUMENT

CROSS-REFERENCE TO RELATED APPLICATIONS

This application is a continuation-in-part of PCT Application No. PCT/US01/30903, having an international filing date of Oct. 2, 2001, and entitled "STRINGED INSTRUMENT TUNER HOLDER", which is based on provisional past application Ser. No. 60/237,336, filed Oct. 2, 2000, and entitled "STRINGED INSTRUMENT TUNER HOLDER".

BACKGROUND OF THE INVENTION

1. Field of the Invention

The present invention relates to tuners for musical instruments, and more particularly relates to electronic tuners for stringed musical instruments.

2. Description of the Prior Art

Stringed musical instruments, such as guitars, are typically tuned through the use of an electronic tuner which is capable of detecting the frequency of vibration generated by plucking, striking, or stroking a single string on the instrument and communicating any difference between the frequency of the generated vibration and a target frequency on a standard musical scale.

When using a tuner, it is necessary to position the tuner so that the visual tuning display, which communicates the difference between the frequency of the generated vibration and the target frequency, is visible to the person tuning the instrument. It is also generally desired to position the tuner close to the sound board hole of the instrument with the transducer (e.g., a microphone) facing the sound board hole in order to maximize reception of sound from the instrument while minimizing any external interference. In an effort to attain these goals while also keeping both hands free to hold, play and tune the instrument, a number of tuners and tuner holders have been developed.

U.S. Pat. No. 5,728,959 describes a clamping holder for a tuner for mounting a tuner on a microphone stand. While effective for positioning the tuner so that the visual tuning display is visible to the person tuning the instrument and the transducer faces the sound board hole of the instrument, the tuner is mounted a significant distance from the sound board hole of the instrument.

U.S. Pat. No. 4,899,636 describes a guitar tuner, which incorporates a suction cup to mount the tuner to the guitar body. While generally effective for allowing positioning of the tuner proximate the sound board hole with the transducer facing the sound board hole and the visual tuning display viewable by the person tuning the guitar, guitar owners are very reluctant to attach such a device to the body of their guitar due to the high probability that the suction cup will mark, scratch, or otherwise damage the guitar body.

U.S. Pat. Des. 353,826 depicts a guitar tuner holder configured and arranged for suspending a platform from the sound board hole of a guitar. The holder includes a centrally located upper knob extending downward from the back edge of the platform for engaging the inner surface of the guitar body through the sound board hole, and a pair of laterally spaced lower knobs extending rearward from right and left legs for engaging the outer surface of the guitar body immediately below the sound board hole. While generally effective for allowing positioning of the tuner proximate the sound board hole in an orientation which allows the person tuning the guitar to view the visual tuning display of the tuner, the platform extends straight out from the sound board hole resulting in a positioning of the tuner immediately in front of the guitar strings such that the tuner interferes with playing of the guitar strings and the transducer is positioned above at least some of the guitar strings.

Accordingly, a need exists for a tuner and holder which may be positioned proximate the sound board hole of a stringed instrument with the transducer facing the sound board hole and the visual tuning display viewable by the person tuning the instrument, without interfering with playing of the instrument.

OBJECTS AND SUMMARY OF THE INVENTION

It is an object of the present invention to provide an electronic tuner having a tuner bracket which is multi-positionable and multi-functional.

It is another object of the present invention to provide an electronic tuner for tuning a musical instrument which may be suspended from the sound board hole of the musical instrument.

It is yet a further object of the present invention to provide an electronic tuner for a musical instrument which has a multi-positionable bracket that may function as a stand for supporting the electronic tuner in a substantially upright position.

It is still another object of the present invention to provide an electronic tuner for tuning a musical instrument which is compact but expandable for attachment to a musical instrument.

It is yet another object of the present invention to provide an electronic tuner for a musical instrument which overcomes the inherent disadvantages of known electronic tuners and tuner holders.

In one form of the present invention, an electronic tuner for tuning a musical instrument, such as guitars having sound board holes, includes a tuner housing which contains the electronic circuitry of the tuner, and a tuner bracket which is selectively slidably and pivotably mounted on the tuner housing.

The tuner housing preferably has two grooves formed on each lateral sidewall of the housing The groove on one sidewall of the housing has an open end at one peripheral end of the housing, and the groove on the other sidewall is closed or has a stop at the same peripheral end.

The tuner bracket of the electronic tuner is selectively pivotally and slidably mounted on the tuner housing. The bracket includes a main body, a hooked end extending from the main body, and opposite parallel sidewalls extending from the main body in an opposite direction from that of the hooked end. The sidewalls of the tuner bracket have inner surfaces which face each other and are separated from each other by a predetermined distance to receive therebetween the tuner housing. At least one of the bracket sidewalls has a first protrusion extending from the inner surface thereof, and each of the bracket sidewalls have at least second protrusions extending from their respective inner surfaces. These second protrusions are received by the corresponding grooves formed in the sidewalls of the tuner housing, and slide within the grooves. The first protrusion formed on one of the bracket sidewalls is also received in a corresponding one of the two grooves formed in the tuner housing. It is also slidable within the groove.

The particular structure of the electronic tuner of the present invention allows the tuner to be used and positioned in multiple ways. In a first position, the bracket rests on the front face of the electronic tuner, with its hooked end at least partially wrapped around one end of the tuner. Preferably, the main body of the bracket does not cover a visual tuning display or various electronic push button switches and other components mounted on the electronic housing so that a musician may use the tuner with the bracket in this "closed" position.

The bracket is also positionable as a stand. The user slides the bracket outwardly from the tuner until the first protrusion passes through the open end of its respective groove. The bracket is then pivoted on the second protrusions downwardly with respect to the tuner housing until the first protrusion contacts the back of the tuner and supports the tuner in a substantially upright position or at a predetermined angle so that the musician can easily view the tuning display on the front face of the tuner. In this second position, the bracket acts as a stand for the tuner so that the tuner may rest on a flat surface or the like.

The bracket, with its hooked end, also functions to allow the musician to hang the tuner from the sound board hole of the musical instrument and view the tuning display while tuning the instrument. When the bracket is extended fully from the housing so that the first protrusion clears the open end of its corresponding groove, the bracket may be pivoted in the opposite direction towards the front face of tuner housing. The bracket preferably locks in place at a particular angle above the front face of the tuner housing, and the musician places the hooked end of the bracket onto the edge of the sound board hole of his instrument. The bracket thus suspends the tuner from the hole at an angle so that the tuning display is viewable by the musician as he tunes his instrument. By the user exerting hand force, the bracket may be pivoted back down from this position and slid onto the tuner housing until the hooked end contacts an edge of the tuner with the bracket at least partially covering the front face of the tuner housing, i.e., the bracket is in a closed position.

These and other objects, features and advantages of the present invention will be apparent from the following detailed description of illustrative embodiments thereof, which is to be read in connection with the accompanying drawing.

DETAILED DESCRIPTION OF THE PREFERRED EMBODIMENTS

Reference is hereby made to U.S. patent application entitled "Stringed Instrument Tuner Holder", to Maxim Hurwicz, filed concurrently herewith, based on PCT Application Serial No. PCT/US01/30903, filed on Oct. 2, 2001, which claims priority to U.S. Provisional Application Serial No. 60/237,336, filed on Oct. 2, 2000, the disclosure of each of which is incorporated herein by reference.

Figure 1:
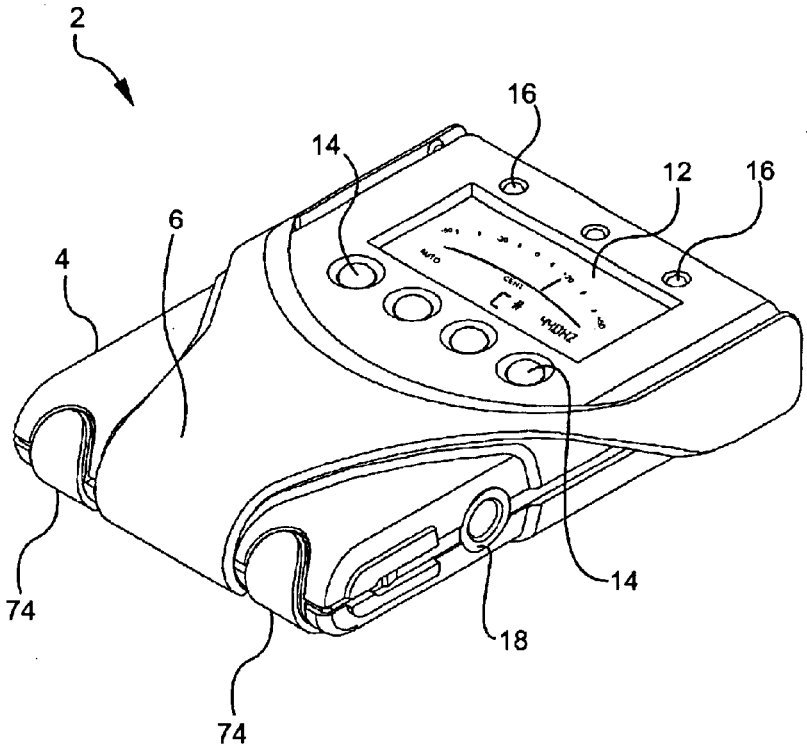
FIG. 1 is an isometric view of the electronic tuner of the present invention, depicting the tuner bracket in a closed position.
Figure 2:
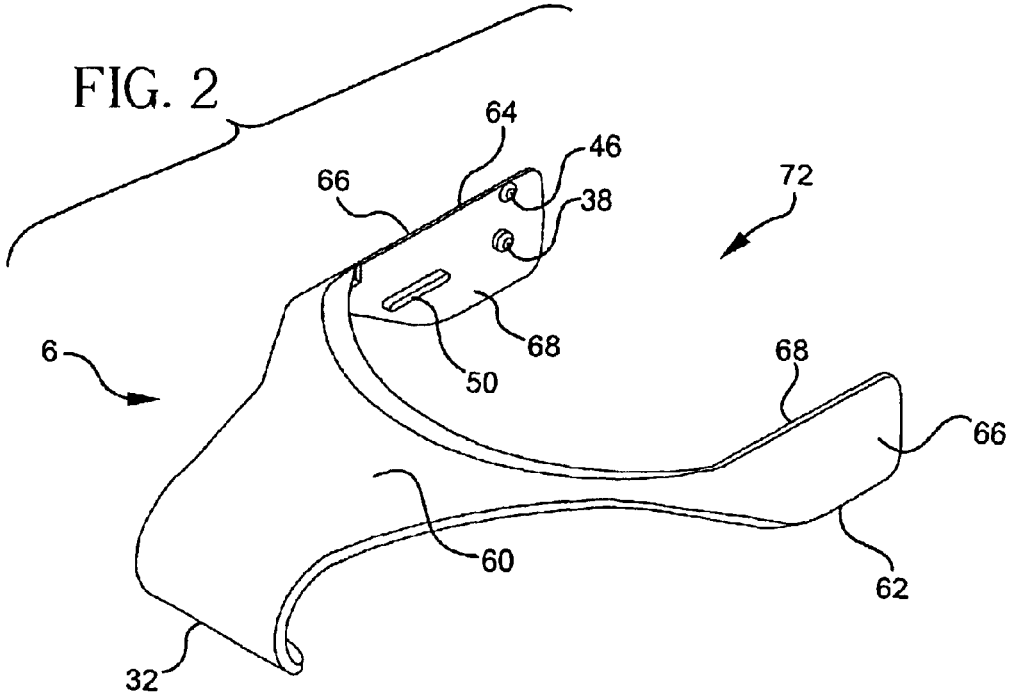
FIG. 2 is an exploded isometric view of the electronic tuner of the present invention shown in FIG. 1.
Figure 2:
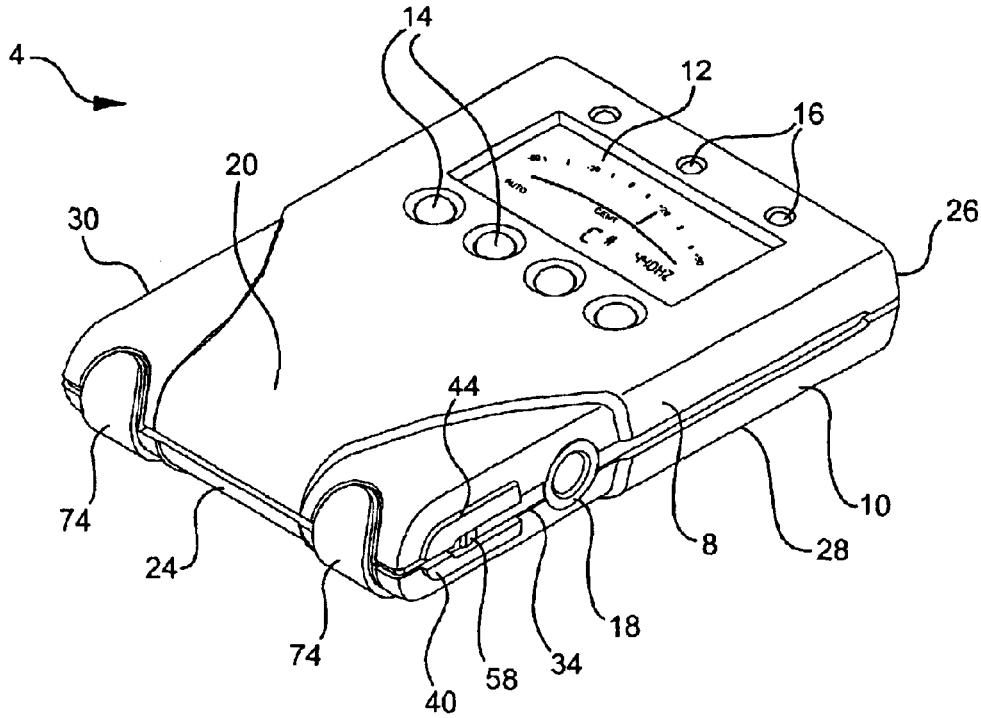
Figure 3:
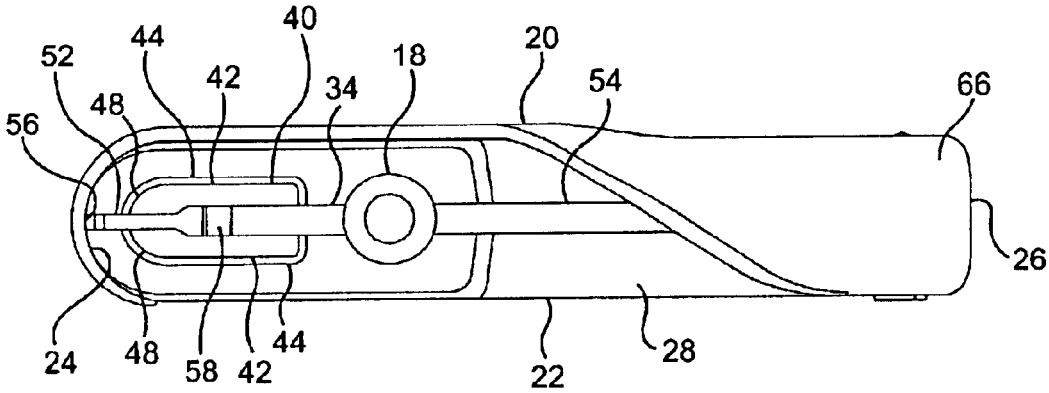
FIG. 3 is a first side view of the electronic tuner of the present invention, depicting the bracket in the closed position as shown in FIG. 1.

Referring initially to FIGS. 1–3 of the drawing, it will be seen that an electronic tuner 2 formed in accordance with the present invention includes a tuner housing 4 and a tuner bracket 6 which selectively slides and pivots on the tuner housing 4. The tuner housing 4 is preferably formed from two mating halves 8, 10 which cooperate to define space therein for housing the electronic circuitry of the tuner 2.

The electronic circuitry of the tuner 2 is conventional and well known to those skilled in the art and, therefore, will not be described in detail herein. Generally, however, the electronic circuitry includes a transducer (e.g., a microphone) for receiving sound waves emitted from the musical instrument, and a visual tuning display 12 viewable by the person tuning the musical instrument. The electronic circuitry may be connected to one or more push button switches 14 for the user to operate or program the electronic tuner and its associated circuitry, as well as one or more light emitting diodes (LEDs) 16 which also function to provide information to the user to assist him in his tuning the musical instrument using the electronic tuner 2.

The electronic tuner 2 may further include an electronic jack, socket or other receptacle 18 for receiving an electronic plug connected to a remotely positioned transducer which is used to sense the vibrations of the plucked string and to generate an electronic signal which is provided to the tuner circuitry for analysis.

Either the built-in transducer or the remote transducer senses the frequency of the vibrating string, and generates a signal corresponding thereto. The signal is provided to the electronic circuitry of the tuner 2, and the electronic circuitry generates a perceptible signal on the visual display 12 which is representative of any difference between the frequency of the vibration of the plucked string and a target frequency on a standard musical scale. The user may view this information on the visual display 12 and adjust the tension of the plucked string accordingly until the target frequency is reached, as indicated on the display 12 or LEDs 16. The electronic circuitry disclosed in U.S. Pat. No. 4,899,636 (Chiba et al.) described previously, or disclosed in any one of U.S. Pat. Nos. 5,637,820 (Wittman), 6,291,755 (Hine et al.) and 5,777,248 (Campbell), the disclosures of which are incorporated herein by reference, may be utilized in the present invention, or variations of such circuitry which are within the capability and knowledge of one skilled in the art, may be used as the circuitry for the tuner of the present invention.

In a preferred form of the present invention, the tuner housing 4 includes a front wall 20, a back wall 22 disposed opposite the front wall 20, opposite first and second end walls 24, 26 situated between the front and back walls 20, 22, a first lateral sidewall 28 and a second lateral sidewall 30 disposed opposite the first lateral sidewall 28. The first and second lateral sidewalls 28, 30 are situated between the first and second end walls 24, 26 and the front and back walls 20, 22. Preferably, the first end wall 24 is curved or rounded to allow a hooked end 32 of the tuner bracket 6 to rest closely against the first end wall 24 when the tuner bracket is in the first (closed or storage) position shown in FIG. 1, as will be described in greater detail.

Figure 3A:
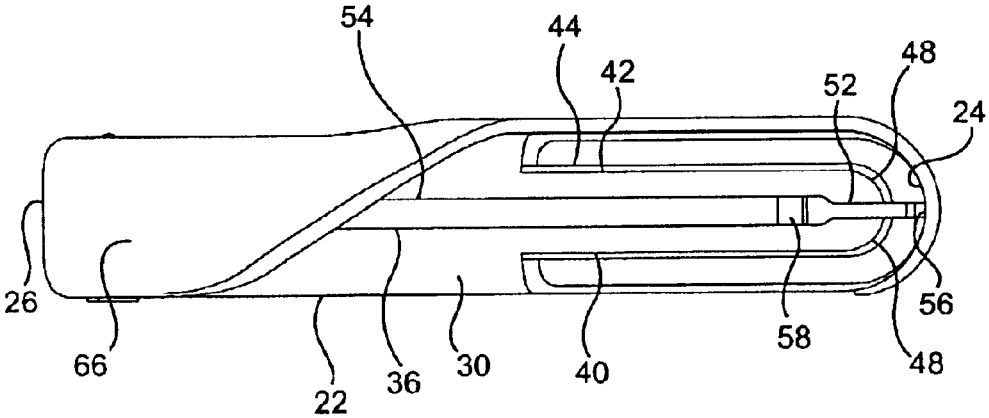
FIG. 3A is a second side view of the electronic tuner of the present invention, depicting the bracket in the closed position as shown in FIG. 1.

As shown in FIGS. 3 and 3A, the first and second lateral sidewalls 28, 30 respectively have a first groove 34 and a second groove 36 formed therein which extends longitudinally at least partially along the length thereof. As shown in FIG. 3, the first groove 34 shown on the first lateral sidewall 28 of the tuner housing may extend entirely along the length of the first lateral sidewall or may terminate prior to the second end wall 26. The second groove 36 formed in the second lateral sidewall 30 may be similarly shaped as the first groove 34, as shown in FIG. 3A of the drawing. The first groove 34 of the first lateral sidewall 28 may be interrupted or may be made shallower where an electronic jack or receptacle 18 is mounted in the first sidewall 28, if such is included. As will be described in greater detail, the particular structure of the tuner housing 4 and tuner bracket 6 compensates for the placement of the electronic jack or receptacle 18 in the first sidewall 28 where the first groove 34 is situated without having any substantial effect on the operation of the tuner bracket and tuner housing and the cooperation between these two components.

Preferably, one or both of the first and second lateral sidewalls 28, 30 of the tuner housing have a "stop" structure situated near the first end wall 24 of the tuner housing. The purpose of such a stop is to prevent a pivot pin 38 (also referred to herein as the "second protrusion") of the tuner bracket 6 from sliding out of its corresponding groove 34, 36 when the tuner bracket is extended from the tuner housing 4, as will be described in greater detail. The stop structure is preferably situated near the first end wall 24 of the tuner housing and in proximity to one or both of the first and second grooves 34, 36, which the pivot pin 38 of the tuner bracket will contact to prevent further movement of the tuner bracket 6 with respect to the tuner housing 4.

In one form of the present invention, this "stop" structure may be in the form of an elongated U-shaped cup 40 which surrounds both sides of either the first groove 34, the second groove 36, or both grooves. More specifically, the elongated U-shaped cup 40 has two straight segments 42 which run on opposite sides of the corresponding groove, adjacent to and parallel with the groove. The segment 42 basically is a ridge or raised surface extending outwardly from the lateral sidewall on which it is formed, and which preferably has a sloped outer surface 44, the purpose of which is to permit a locking protrusion 46 (hereinafter also referred to as the "third protrusion") formed on the tuner bracket 6 to ride over the straight segment 42 of the U-shaped cup so that the protrusion 46 may be received by and selectively retained within the corresponding groove 34, 36.

The preferred form of the "stop" structure, that is, the elongated U-shaped cup 40, also includes a pair of curved segments 48 adjacent the straight segments 42 and formed on either side of its respective groove 34,36. The radius of the inside surface of the curved segments 48 is at least the same as, but is preferably slightly greater than, the radius of the pivot pin 38 on the tuner bracket so that the pivot pin is held captive within the U-shaped elongated cup 40 and groove in which it reciprocatingly slides and pivots. The U-shaped cup 40 thus defines a deeper track in which the pivot pin 38 moves.

Preferably, the curved segments 48 of the U-shaped cup are separated a predetermined distance to allow another protrusion, preferably in the form of a rib 50 (also referred to herein as the "first protrusion"), to pass therebetween and beyond the first end wall 24 of the tuner housing, as will be described in greater detail.

Preferably, one or both of the first and second grooves 34, 36 formed respectively in the first and second lateral sidewalls 28,30 of the tuner housing are defined with at least a first portion 52 having a first transverse groove width and a second portion 54 having a second transverse groove width. The first groove width over the first portion 52 is less than the second groove width over the second portion 54. The first portion 52 of the groove is positioned nearer the first end wall 24 of the tuner housing than the second portion 54 of the groove, and the second portion 54 of the groove is situated nearer the second end wall 26 of the tuner housing than the first portion 52 of the groove. Again, either one or both of the first and second grooves 34,36 may have this particular structure.

One, or both, of the first and second grooves 34,36 formed respectively in the first and second lateral sidewalls of the tuner housing has an open end 56 situated at the first end wall 24 of the tuner housing This is provided to allow the first protrusion 50 of the tuner bracket 6 to pass therethrough and beyond the open end 56 of the groove and the first end wall 24 of the tuner housing, while the pivot pin 38 (i.e., the second protrusion) remains captive within its respective groove. This juncture between the wider second portion 54 and the narrower first portion 52 of the groove defines another "stop" structure to prevent further longitudinal movement of the pivot pin 38 within the groove.

Figure 7:
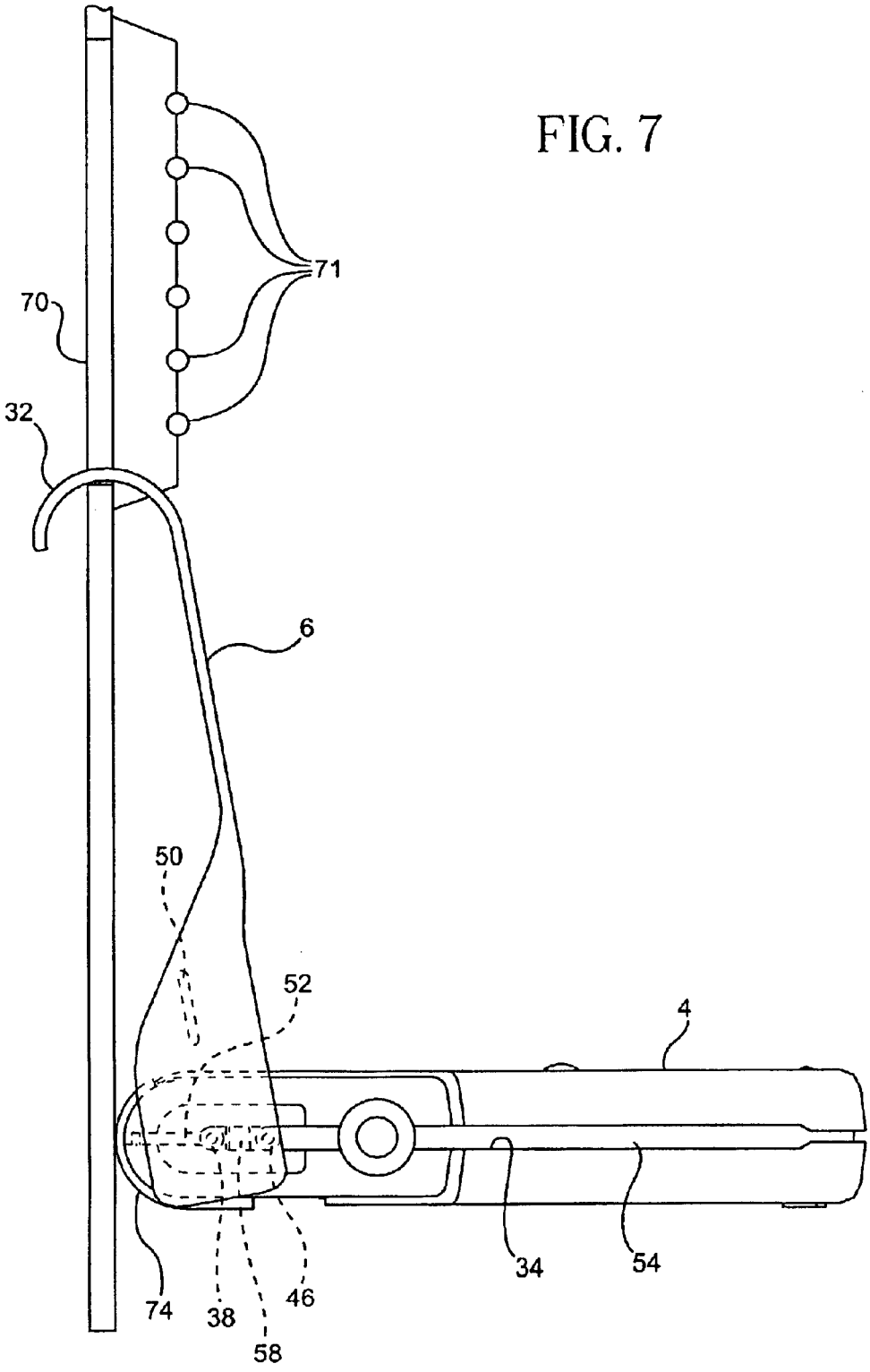
FIG. 7 is a side view of the electronic tuner of the present invention, depicting the bracket in a position to allow the tuner to be suspended from the musical instrument, in the same manner as shown in FIG. 6.

As can be seen in FIGS. 1, 2 and 7, each or both of the first and second grooves 34, 36 may include a protrusion, or more preferably, a ramp 58 formed in the corresponding lateral sidewall surface defining the bottom of the groove. The ramp 58 is spaced away from the "stop" structure (such as a closed end of the groove, the curved segments 48 of the elongated U-shaped cup, or the juncture of the wide- and narrow portions 54, 52 of the groove) a distance to permit the pivot pin 38 (i.e., the second protrusion) to ride over the ramp 58 from one side and be held captive in the groove on the other side until the user exerts hand pressure on the bracket 6 to force the pin 38 to travel back over the ramp and through the groove toward the second end wall 26 of the housing, such as when the user slides the bracket 6 on the housing 4 toward its closed position.

Referring now to FIG. 2 of the drawing, the preferred form of the tuner bracket 6 will now be described. The tuner bracket 6 preferably has a main body 60, a hooked end 32 extending from the main body 60 in one direction, a first sidewall 62 and a second sidewall 64 situated opposite the first sidewall 62. The first and second sidewalls 62, 64 of the tuner bracket extend in substantially the same direction from the main body 60 and in a substantially opposite direction from which the hooked end 32 extends. The first and second sidewalls 62, 64 of the tuner bracket are substantially parallel to and spaced apart from one another.

Each of the first and second sidewalls 62, 64 of the tuner bracket has an outer surface 66 and an opposite inner surface 68. The inner surfaces 68 of the spaced apart first and second sidewalls arc situated to face each other. The spaced apart first and second sidewalls 62, 64 of the tuner bracket are separated from each other a predetermined distance to receive therebetween the tuner housing 4. The tuner bracket 6 and tuner housing 4 may be made from any suitable material, but are preferably made from a plastic material. Also, the two sidewalls 62, 64 of the tuner bracket are preferably at least partially or slightly resilient so that they may be fitted over the tuner housing and closely engage the lateral sidewalls 28, 30 of the housing.

Figure 4:
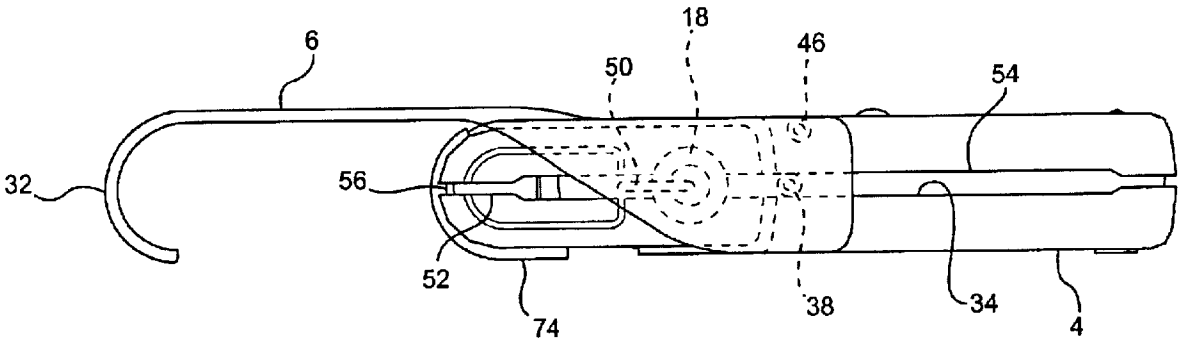
FIG. 4 is a side view similar to that shown in FIG. 3 of the electronic tuner of the present invention, depicting the bracket partially extended on the tuner housing.
Figure 5:
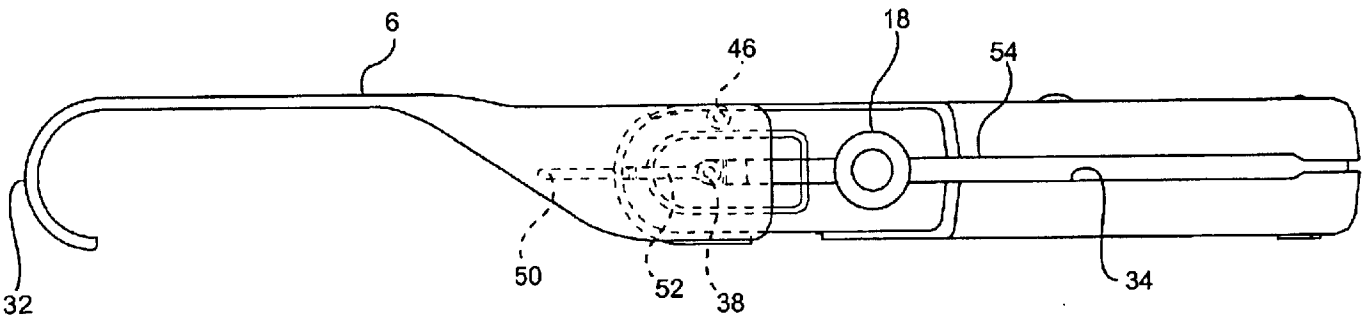
FIG. 5 is a side view of the electronic tuner of the present invention, depicting the bracket fully extended on the housing.

As can be seen in FIG. 2, as well as in FIGS. 3–5 of the drawing, the hooked end 32 is curved inwardly, and has a curvature which substantially conforms to the curvature of the first end wall 24 of the tuner housing. In this way, the hooked end 32 can fit closely in abutting contact with the first end wall 24 of the tuner housing when the tuner bracket 6 is situated on the tuner housing 4 in the first or closed position, as shown in FIGS. 1, 3 and 3A. The hooked end 32 of the tuner bracket is provided so that the tuner of the present invention may be suspended from the sound board hole 70 of the stringed musical instrument being tuned, as shown in FIG. 7 of the drawing As mentioned previously, one or both of the first and second sidewalls 62, 64 of the tuner bracket may include one or more protrusions, as shown in FIG. 2 and in FIGS. 3–5 of the drawing. More specifically, preferably both of the first and second sidewalls 62, 64 of the tuner bracket include a pivot pin 38 (i.e., the "second protrusion") which extends from the inner surface 68 thereof so that both pivot pins face inwardly towards the space defined between the first and second sidewalls 62, 64 of the tuner bracket. These pivot pins 38 are received in the corresponding first and second grooves 34, 36 respectively formed in the first and second lateral sidewalls 28, 30 of the tuner housing The pivot pins 38 have a width or diameter which is at most equal to (and is preferably at least slightly less than) the width of the groove 34, 36 in which they are received so that they may slide and pivot within the grooves. If the groove is formed with first and second portions 52, 54 having different transverse groove widths, then the pivot pin 38 has a width or diameter which is at most equal to (and is preferably slightly less than) the transverse groove width of the second portion 54 of the groove, but has a width or diameter which is greater than the transverse groove width of the first portion 52 of the groove. As mentioned previously, the width of the second portion 54 of the groove is greater than the width of the first portion 52. Thus, if the groove is formed with two portions having different widths, then the pivot pin 38 will be able to reciprocatingly slide within the second portion 54 of the groove but will be incapable of entering the first portion 52 and, thereby, will be retained within the second portion of the groove. Thus, the juncture between the narrower first portion 52 and the wider second portion 54 of the groove acts as a stop to prevent the pivot pin 38 (that is, the "second protrusion") from further movement within the groove as the tuner bracket 6 is extended by the user from the tuner housing 4.

As mentioned previously, the tuner bracket also includes a first protrusion 50 formed on one or both of the first and second sidewalls 52, 54. The first protrusion 50 extends from the inner surface 68 of the first or second sidewall on which it is formed, in much the same manner as the pivot pin 38 described previously. It is spaced apart from the pivot pin 38, and is preferably positioned with respect to the pivot pin in the same general direction of longitudinal movement of the tuner bracket 6 on the tuner housing 4 so that the first protrusion 50 may be received by a corresponding groove (either the first or second grooves 34, 36, or both) of the first or second lateral sidewall 28, 30 of the tuner housing.

As shown in FIGS. 2 and 3–5 of the drawing, the first protrusion 50 is preferably in the form of an elongated rib or fin, although it may also be in the form of a pin or other shape. The width of the first protrusion 50 (i.e., the transverse width of the rib) is at most equal to (and is preferably slightly less than) the width of the first portion 52 of the tuner housing groove in which it is received. This allows the rib 50 to be received by and reciprocatingly slide in not only the wider second portion 54 of the groove but also the narrower first portion 52. The first protrusion or rib 50 is also spaced apart from the second protrusion or pivot pin 38 a distance which is at least equal to (and is preferably slightly greater than) the length of the first portion 52 of the groove of the tuner housing in which it resides. That is, the spacing between the first and second protrusions (i.e., the rib 50 and the pivot pin 38) on one or both of the sidewalls 62, 64 of the tuner bracket is at least equal to (and is preferably slightly greater than) the distance from the stop structure (which prevents further movement of the pivot pin 38 in its respective groove) and the open end 56 of the groove or the first end wall 24 of the housing to allow the rib to completely pass through the groove, and in particular the first portion 52 thereof if such is provided, and clear the first end wall 24 of tuner housing. This will allow the tuner bracket 6 to remain attached to the tuner housing 4 but be positioned on the tuner housing in several different positions, as the second protrusion or pivot pin 38 pivotally resides within its corresponding groove (and in particular, the wider second portion 54 of the corresponding groove, if such is provided) of the tuner housing.

As further mentioned previously, one or both of the first and second sidewalls 62, 64 of the tuner bracket may include a third or "locking" protrusion 46, as shown in FIGS. 2–5, 7 and 9 of the drawing. This locking protrusion 46 is preferably in the form of a smoothed truncated cone, or "bump", with sloping sidewalls and which extends preferably only slightly from the inner surface 68 of either or both of the first and second sidewalls 62, 64 of the tuner bracket. This locking protrusion 46 is used to retain the tuner bracket 6 in a particular position at an angle to the tuner-housing 4. Preferably, the third "locking" protrusion 46 engages the corresponding lateral sidewall of the tuner housing and is received in the groove 34, 36 formed therein as the tuner bracket 6 is pivoted about its pivot pins 38 with respect to the tuner housing 4. If the lateral sidewalls 28, 30 are provided with the elongated U-shaped cup 40, or some other raised surface situated on at least one side of one or both of the grooves, the locking protrusion 46 is forced to ride up over the sloped outer surface 44 of the U-shaped cup segments (or other raised surface) and into the groove when the tuner bracket 6 is pivoted on the tuner housing 4, where it is selectively retained until the user exerts hand pressure on the tuner bracket 6 to pivot it back downwardly with respect to the tuner housing 4 from its locked position. The resiliency of the first and second sidewalls 62, 64 of the tuner bracket helps facilitate the movement of the third protrusion 46 into and out of the groove and over the elongated U-shaped cup 40 (or other raised surface) of the tuner housing.

As shown in FIG. 3 of the drawing, the tuner bracket 6 is shown in its closed or storage position, where it closely engages the tuner housing 4. More specifically, the hooked end 32 of the tuner-bracket rests closely against the first end wall 24 of the tuner housing, and the main body 60 of the tuner bracket overlies at least a portion of the front wall 20 of the tuner housing. It should be noted here that the first and second sidewalls 62, 64 and/or the main body 60 of the tuner bracket define between them an open viewing area 72 which does not cover the visual tuning display 12 or the LEDs 16 and allows access to the push button switches 14 through this open area 72. Thus, a user may operate the electronic tuner 2 of the present invention with the tuner bracket 6 fully engaged on the tuner housing 4. The electronic tuner 2, with the tuner bracket in such a position, has a compact shape for storage, yet it is usable by a musician with the bracket in this position for tuning his musical instrument.

As further shown in FIG. 3, it is clear that the pivot pin 38 (i.e., the second protrusion) and the rib 50 (i.e., the first protrusion) reside in their corresponding groove formed in the first and second lateral sidewalls 28, 30 of the tuner housing, and are reciprocatingly slidable therein. More specifically, if the groove is formed with a wider second portion 54 and a narrower first portion 52, both the pivot pin 38 and the rib 50 reside in the second portion 54 when the tuner bracket 6 is in the closed or storage position with respect to the tuner housing 4.

If the user wishes to employ the tuner bracket 6 as a stand or as a hook to suspend the tuner from the instrument, he slides the tuner bracket 6 outwardly along the longitudinal axis of the grooves 34, 36 of the tuner housing, as shown in FIG. 4. The first and second protrusions 50, 38 will slide within their respective groove. It should be noted herein that, as shown in FIG. 4, the length of the rib 50 (i.e., the first protrusion) is at least equal to (and is preferably greater than) the width of the electronic jack or socket 18, if such is provided in the sidewall of the tuner housing, so that the rib 50 does not inadvertently come out of its respective groove 34, 36 where the electronic jack is situated, as such a jack may interfere with the groove or the groove may be shallower where the jack is located. The rib 50, in other words, bridges the gap or space in the groove where the jack 18 is located. Consequently, the tuner bracket 6 remains slidably attached to the tuner housing 4.

As shown in FIG. 5, the tuner bracket 6 may be extended until the pivot pin 38 on one or both of the sidewalls 62, 64 of the tuner bracket reaches its "stop" structure. This may be, for example, where the wider second portion 54 of the groove meets the narrower first portion 52. Further outward, longitudinal movement of the tuner bracket 6 is prevented, as the wider width of the pivot pin 38 prevents it from entering the narrower first portion 52 of the groove. If an elongated U-shaped cup 40 is provided on the sidewall of the tuner housing, the separation between the curved segments 48 of the U-shaped cup is less than the width or diameter of the pivot pin 38, and this further prevents the pivot pin from disengaging from the groove or entering the separation between the curved segments 48 of the U-shaped cup. It should be further noted that the separation between-the straight segments 42 of the U-shaped elongated cup is at least the same as (or is preferably slightly greater than ) the width or diameter of the pivot pin 38 so that the pivot pin is retained between the straight segments 42 of the U-shaped cup and remains within its respective groove.

As also shown in FIG. 5, the rib or first protrusion 50 passes through the first narrower portion 52 of the groove. Because it is spaced from the pivot pin 38 a predetermined distance, the rib 50 passes through the open end 56 of the groove and clears the first end wall 24 of the tuner housing. In this position, the tuner bracket 6 may now be pivoted about its pivot pins 38 either upwardly or downwardly with respect to the tuner housing 4.

Figure 6:
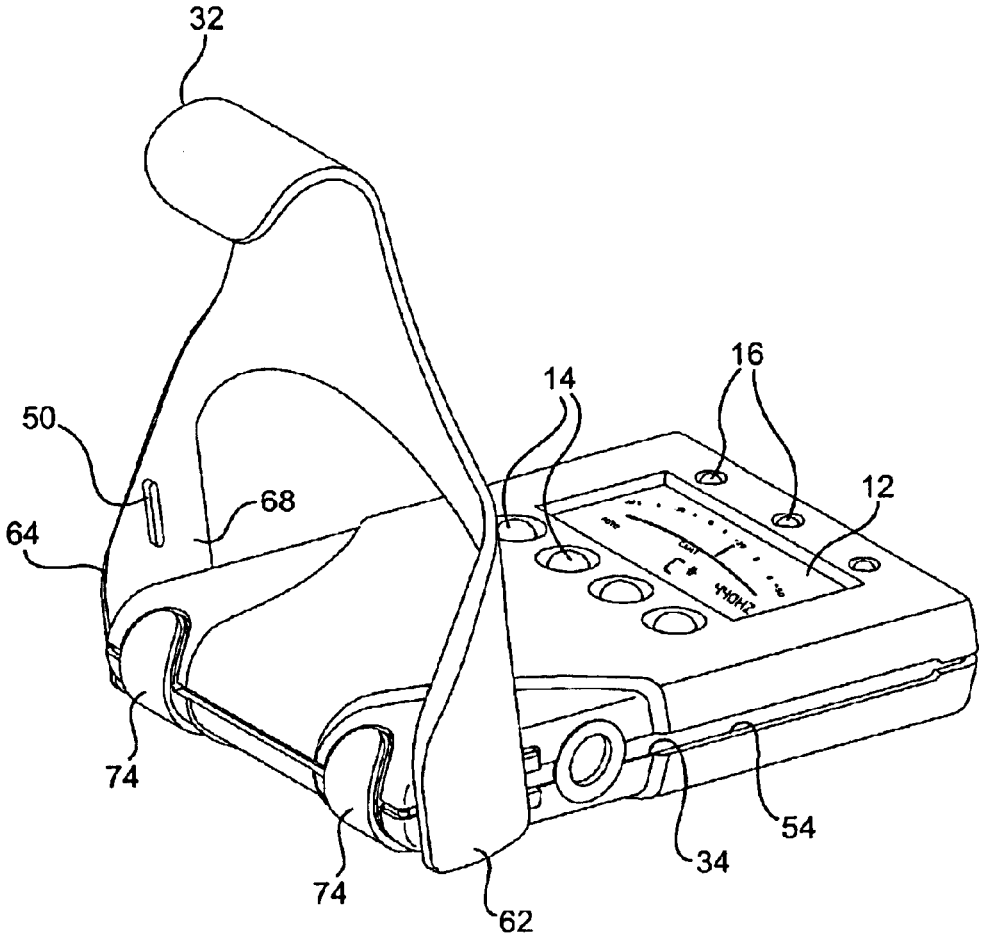
FIG. 6 is an isometric view of the electronic tuner of the present invention, showing the bracket positioned to be hooked onto the sound board hole of a stringed musical instrument.

As mentioned previously, the tuner bracket may be positioned so that it may be suspended from the sound board hole 70 of a stringed musical instrument, such as a guitar, preferably below the strings 71. As shown in FIGS. 6 and 7 of the drawing, the tuner bracket 6 is pivoted about its pivot pins 38 upwardly towards the front wall 20 of the tuner housing. The third protrusion, or locking protrusion 46, is forced by hand pressure to ride over the sloped outer surface 44 of the U-shaped cup until it is received by its respective groove formed in the lateral sidewall of the tuner housing, and is retained therein due to the resiliency of the sidewalls 62, 64 of the tuner bracket. The locking protrusion 46 is situated with respect to the pivot pin 38 on the inner surface 68 of its respective bracket sidewall such that, when it is received by the same groove in which the pivot pin 38 resides, it maintains the tuner bracket 6 at a particular angle with respect to the front wall 20 of the tuner housing 4. In this position, the tuner bracket 6, preferably at its main body 60, forms an angle with the front wall 20 of the tuner housing of between about 80° and about 120°, and more preferably forms-an angle with the front wall of the tuner housing of about 100°. This is the preferred angle for the musician to view the visual tuning display 12 while the electronic tuner of the present invention is suspended from the musical instrument by having its hooked end 32 engaging the edge of the sound board hole 70 of the musical instrument.

As shown in FIG. 6 of the drawing, a pair of rubber (or other cushion material) feet 74 are preferably mounted on the curved first end wall 24 of the tuner housing. When the tuner 2 is suspended from the sound board hole 70 of the musical instrument, the rubber feet 74 rest on the surface of the instrument and are provided so that the tuner 2 does not mar the surface of the musical instrument. The rubber feet 74 also provide an anti-slip feature to the electronic tuner of the present invention so as to minimize movement or slippage of the tuner on the sound board of the musical instrument as the instrument is being tuned. The musician need only exert hand force to reposition the tuner bracket 6 with respect to the tuner housing 4, that is, to force the locking protrusion 50 out of its respective groove and over the elongated U-shaped cup 40 or other raised surface, if such is provided.

Figure 8:
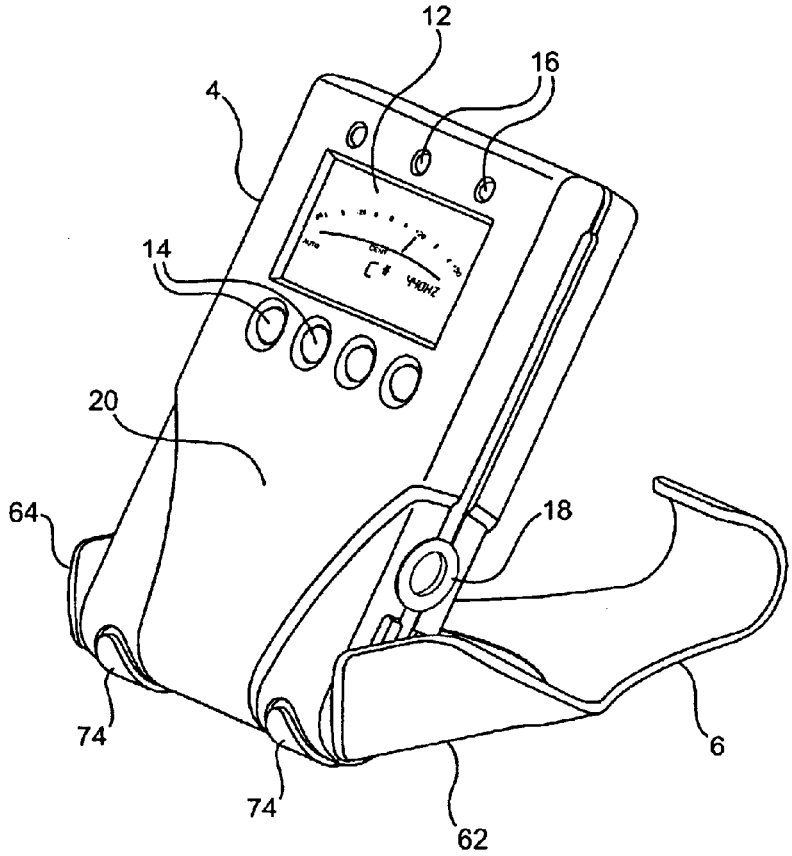
FIG. 8 is an isometric view of the electronic tuner of the present invention, depicting the bracket in a position where it functions as a stand for the tuner.
Figure 9:
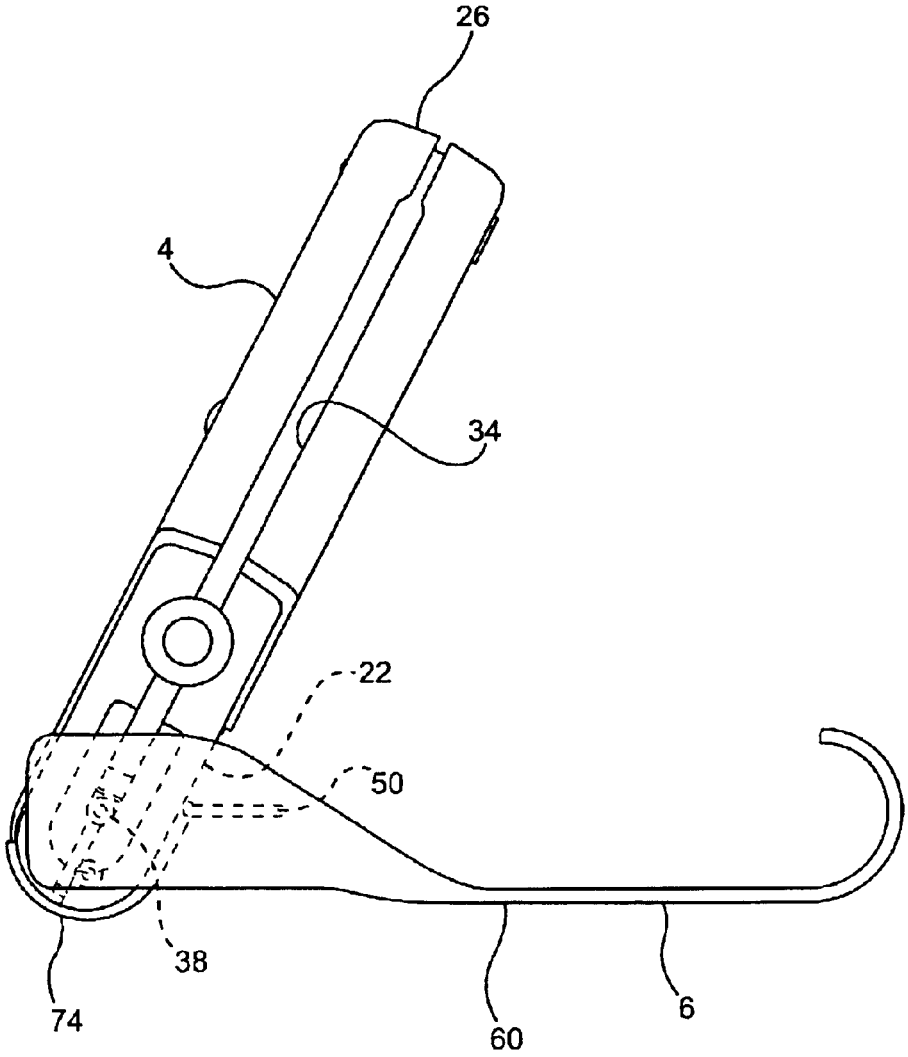
FIG. 9 is a side view of the electronic tuner of the present invention, depicting the bracket in a position where it functions as a stand for the electronic tuner in the same manner as shown in FIG. 8.

The tuner bracket 6 may also be positioned to a serve as a stand for supporting the electronic tuner 2 of the present invention. As shown in FIGS. 8 and 9, the tuner bracket 6, when in its fully extended position, may be pivoted downwardly with respect to the tuner housing 4 until the rib 50 or first protrusion engages the back wall 22 of the tuner housing. In this position, the bracket 6 may rest on a tabletop or other flat surface, with the tuner housing 4 being disposed in an upright or slightly angled position for viewing by the musician as he tunes his musical instrument. Again, the rubber feet 74 will prevent the tuner 2 from slipping on the tabletop or other flat surface and will prevent the tuner from marring the surface. Preferably, in this position, the tuner bracket (and preferably the main body 60 thereof) forms an angle with the back wall 22 of the tuner housing of between about 45° and about 85°, and more preferably forms an angle with the back wall 22 of the tuner housing of about 65°. This is the preferred angle for viewing the visual tuning display 12 and LEDs 16 on the front wall 20 of the tuner housing 4 when the tuner bracket 6 is positioned as a stand.

The electronic tuner 2 of the present invention, with its tuner housing 4 and cooperating tuner bracket 6, may be used in various positions and modes. It may bemused when the bracket is fully engaged on the tuner housing in its closed or storage position and, in this form, provides a compact shape for easy transportation in one's pocket. The multi-positional and multi-functional bracket 6 also supports the electronic tuner of the present invention on a tabletop or other flat surface by acting as a stand, and also is positionable so that the electronic tuner 2 may be suspended from the sound board hole 70 of the musical instrument being tuned and in a position so that the musician tuning the instrument may easily view the visual tuning display 12 and LEDs 14 situated on the front wall 20 of the tuner housing.

As mentioned previously, although it may be preferred to have a "stop" structure provided on both lateral sidewalls 28, 30 of the tuner housing, it is possible to provide such structure on only one sidewall to retain the tuner bracket to the tuner housing. Also, it is envisioned that only one sidewall of the tuner bracket has the rib 50 (i.e., the first protrusion) or the locking protrusion 46 (i.e., the third protrusion), as the tuner bracket 6 will still be slidable and pivotable with respect to the tuner housing 4 with only one sidewall of the tuner bracket having such protrusions. Furthermore, the rib 50 may be on a different bracket sidewall 62, 64 from where the locking protrusion 46 is situated.

It is also envisioned to be within the scope of this invention, as mentioned previously, to have single width grooves 34, 36 formed on either or both of the lateral first and second sidewalls 28, 30 of the tuner housing, although it is preferred to have at least one of the sidewalls formed with a groove having a narrower first portion 52 and a wider second portion 54, as described previously.

It should be further realized that, although the electronic tuner 2 of the present invention is described herein as being used for tuning a stringed musical instrument, such as a guitar, it is quite suitable for use with both stringed and unstringed musical instruments, including wind instruments and others, and stringed instruments having no sound board hole.

Although illustrative embodiments of the present invention have been described herein with reference to the accompanying drawing, it is to be understood that the invention is not limited to those precise embodiments, and that various other changes and modifications may be effected therein by one skilled in the art without departing from the scope or spirit of the invention.

What is claimed is:

1. An electronic tuner for tuning a musical instrument, which comprises:

a tuner housing, the tuner housing having a front wall, a back wall opposite the front wall, opposite first and second end walls situated between the front and back walls, a first lateral sidewall and a second lateral sidewall opposite the first lateral side wall, the first and second lateral sidewalls being situated between the first and second end walls and the front and back walls, the first lateral sidewall having a first groove formed therein and extending longitudinally at least partially along the length thereof, the second lateral sidewall having a second groove formed therein and extending longitudinally at least partially along the length thereof, the first groove having an open end situated at the first end of the tuner housing; and a tuner bracket, the tuner bracket having a main body, a hooked end extending from the main body, a first sidewall and a second sidewall situated opposite the first sidewall, the first and second sidewalls of the tuner bracket extending in substantially the same direction from the main body and in a substantially opposite direction from which the hooked end extends, and being further substantially parallel to and spaced apart from one another, each of the first and second sidewalls of the tuner bracket having an outer surface and an opposite inner surface, the inner surfaces of the spaced apart first and second sidewalls of the tuner bracket being situated to face each other, the spaced apart first and second side walls of the tuner bracket being separated from each other a predetermined distance to at least partially receive therebetween the tuner housing, at least the first sidewall of the tuner bracket having a first protrusion extending from the inner surface thereof, the first and second sidewalls of the tuner bracket having second protrusions extending from the inner surfaces thereof, the first and second protrusions of the first sidewall of the tuner bracket being spaced apart from each other;

the tuner bracket being mounted on the tuner housing such that the first and second protrusions of the first sidewall of the tuner bracket are slidably receivable by the first groove formed in the first lateral sidewall of the tuner housing and the second protrusion of the second sidewall of the tuner bracket is slidably receivable by the second groove formed in the second lateral sidewall of the tuner housing, the tuner bracket being selectively pivotable on the tuner housing about the second protrusions.

2. An electronic tuner for tuning a musical instrument as defined by claim 1, wherein at least one of the first and second lateral sidewalls of the tuner housing includes a stop situated in proximity to at least one of the first and second grooves to selectively retain at least one of the second protrusions of the tuner bracket within at least one of the corresponding first and second grooves.

3. An electronic tuner for tuning a musical instrument as defined by claim 2, wherein the stop is formed on each of the first and second lateral sidewalls of the tuner housing and situated in proximity to the first end of the tuner housing, each of the stops retaining the second protrusions of the tuner bracket within corresponding first and second grooves of the tuner housing.

4. An electronic tuner for tuning a musical instrument as defined by claim 2, wherein the stop formed on the first lateral sidewall selectively retains the second protrusion formed on the first sidewall of the tuner bracket within the first groove and allows movement of the at least first protrusion formed on the first sidewall of the tuner bracket to pass through the open end of the first groove.

5. An electronic tuner for tuning a musical instrument as defined by claim 1, wherein at least one of the first and second sidewalls of the tuner bracket includes a third protrusion, the third protrusion being formed on the inner surface of the at least one of the first and second sidewalls of,the tuner bracket, the third protrusion being selectively received in at least one of the first and second grooves of the tuner housing as the tuner bracket pivots on the tuner housing about the second protrusions.

6. An electronic tuner for tuning a musical instrument as defined by claim 5, wherein the third protrusion is positioned on the at least one of the first and second sidewalls of the tuner bracket such that the tuner bracket and the front wall of the tuner housing form an angle therebetween of between about 80 degrees and about 120 degrees when the second and third protrusions reside in the at least one of the first and second grooves of the tuner housing.

7. An electronic tuner for tuning a musical instrument as defined by claim 5, wherein the third protrusion is positioned on the at least one of the first and second sidewalls of the tuner bracket such that the tuner bracket and the front wall of the tuner housing form an angle therebetween of about 100 degrees when the second and third protrusions reside in the at least one of the first and second grooves of the tuner housing.

8. An electronic tuner for tuning a musical instrument as defined by claim 5, wherein the first and second sidewalls of the tuner bracket are at least partially resilient to allow movement of the third protrusion into and out of the at least one of the first and second grooves of the tuner housing by a user of the tuner apply hand force.

9. An electronic tuner for tuning a musical instrument as defined by claim 5, wherein the at least one of the first and second lateral sidewalls of the tuner housing includes a raised surface formed thereon and situated on at least one side of the at least one of the first and second grooves to help selectively retain the third protrusion within the at least one of the first and second grooves.

10. An electronic tuner for tuning a musical instrument as defined by claim 9, wherein the raised surface is in the form of an elongated U-shaped cup which resides on opposite sides of the at least one of the first and second grooves.

11. An electronic tuner for tuning a musical instrument as defined by claim 1, wherein the first protrusion is in the form of an elongated rib; and wherein the second protrusion is in the form of a cylindrical pin.

12. An electronic tuner for tuning a musical instrument as defined by claim 11, wherein the tuner housing has an electrical socket for receiving an electrical plug, the electrical socket being mounted on one of the first and second lateral sidewalls of the tuner housing, the electrical socket having a width; and wherein the rib has a length which is at least equal to the width of the electrical socket.

13. An electronic tuner for tuning a musical instrument as defined by claim 1, wherein the tuner bracket is positionable on the tuner housing such that the second protrusions correspondingly reside in the first and second grooves formed respectively in the first and second lateral sidewalls of the tuner housing, and the at least first protrusion engages the back wall of the tuner housing, the tuner bracket acting as a stand to support the tuner housing at a particular angle defined between the back wall of the tuner housing and the tuner bracket.

14. An electronic tuner for tuning a musical instrument as defined by claim 13, wherein the particular angle defined between the tuner housing and the tuner bracket is between about 45 degrees and about 85 degrees.

15. An electronic tuner for tuning a musical instrument as defined by claim 13, wherein the particular angle defined between the tuner housing and the tuner bracket is about 65 degrees.

16. An electronic tuner for tuning a musical instrument, which comprises:

a tuner housing, the tuner housing having a front wall, a back wall opposite the front wall, opposite first and second end walls situated between the front and back walls, a first lateral sidewall and a second lateral sidewall opposite the first lateral sidewall, the first and second lateral sidewalls being situated between the first and second end walls and the front and back walls, the first lateral sidewall having a first groove formed therein and extending longitudinally at least partially along the length thereof, the second lateral sidewall having a second groove formed therein and extending longitudinally at least partially along the length thereof, at least the first groove being defined with at least a first portion having a first transverse groove width and a second portion having a second transverse groove width, the first groove width over the first portion being less than the second groove width over the second portion, the first portion of the first groove being positioned nearer the first end of the tuner housing than the second portion of the first groove, and the second portion of the first groove being positioned nearer the second end of the tuner housing than the first portion of the first groove, at least the first groove having an open end situated at the first end of the tuner housing; and a tuner bracket, the tuner bracket having a main body, a hooked end extending from the main body, a first sidewall and a second sidewall situated opposite the first sidewall, the first and second sidewalls of the tuner bracket extending in substantially the same direction from the main body and in a substantially opposite direction from which the hooked end extends, and being substantially parallel to and spaced apart from one another, each of the first and second sidewalls of the tuner bracket having an outer surface and an opposite inner surface, the inner surfaces of the spaced apart first and second sidewalls of the tuner bracket being situated to face one another, the spaced apart first and second sidewalls of the tuner bracket being separated from each other a predetermined distance to receive at least partially therebetween the tuner housing, each of the first and second sidewalls of the tuner bracket having a second protrusion extending from the inner surface thereof, and at least the first sidewall of the tuner bracket having at least a first protrusion extending from the inner surface thereof and spaced apart from the second protrusion formed thereon, the first and second protrusions having respectively first and second widths, the first width being less than the second width, the second width of the second protrusion of the second sidewall of the tuner bracket being at most equal to the width of the second groove of the tuner housing to allow the second protrusion to be slidably received thereby, the first width of the first protrusion formed on the at least first sidewall of the tuner bracket being at most equal to the first groove width of the at least first groove of the tuner housing over the first portion thereof to allow the first protrusion to be slidably received thereby, the second width of the second protrusion formed on the first sidewall of the tuner bracket being at most equal to the second groove width of the second portion of the at least first groove and being greater than the first groove width of the first portion of the at least first groove to allow the second protrusion to be slidably received by the at least first groove and slidable therein over only the second portion thereof;

the tuner bracket being mounted on the tuner housing such that the first and second protrusions of the first sidewall of the tuner bracket and the at least second protrusion of the second sidewall of the tuner bracket are respectively slidably receivable by the first and second grooves respectively formed in the first and second lateral sidewalls of the tuner housing, the second protrusions allowing the tuner bracket to selectively pivot with respect to the tuner housing.

17. An electronic tuner for tuning a musical instrument as defined by claim 16, wherein the hooked end of the tuner bracket has a shape which substantially conforms to the shape of the first end of the tuner housing, the tuner bracket being positionable on the tuner housing in a first position such that the first and second protrusions of the tuner bracket reside in corresponding first and second grooves of the tuner housing, with the hooked end of the tuner bracket being situated in close proximity to the first end of the housing, and with the main body of the tuner bracket being situated in overlying relationship with at least a portion of the front wall of the tuner housing.

18. An electronic tuner for tuning a musical instrument as defined by claim 16, wherein the first and second protrusions of at least the first sidewall of the tuner bracket are spaced apart from each other a distance which is at least equal to the length of the first portion of the at least first groove formed in the tuner housing to permit the tuner bracket to be positionable on the tuner housing in at least a second position, wherein the second protrusion of each of the first and second sidewalls of the tuner bracket pivotally resides respectively in the first and second grooves of the tuner housing, and wherein the first protrusion of at least the first sidewall of the tuner bracket resides outside the first groove of the tuner housing, thereby allowing the tuner bracket to pivot on the tuner housing about the second protrusions.

19. An electronic tuner for tuning a musical instrument as defined by claim 18, wherein the tuner bracket includes a third protrusion, the third protrusion being formed on the inner surface of at least one of the first and second sidewall of the tuner bracket, the third protrusion being selectively received in at least one of the first and second grooves of the tuner housing as the tuner bracket pivots on the tuner housing about the second protrusions.

20. An electronic tuner for tuning a musical instrument as defined by claim 19, wherein the third protrusion is positioned on the at least one of the first and second sidewalls of the tuner bracket such that the main body of the tuner bracket and the front wall of the tuner housing form an angle therebetween of about 80 degrees and about 120 degrees when the second and third protrusions reside in at least one of the first and second grooves of the tuner housing.

21. An electronic tuner for tuning a musical instrument as defined by claim 19, wherein the third protrusion is positioned on the at least one of the first and second sidewalls of the tuner bracket such that the main body of the tuner bracket and the front wall of the tuner housing form an angle therebetween of about 100 degrees when the second and third protrusions reside in at least one of the first and second grooves of the tuner housing.

22. An electronic tuner for tuning a musical instrument as defined by claim 19, wherein the first and second sidewalls of the tuner bracket are at least partially resilient to allow movement of the third protrusion into and out of at least one of the first and second grooves of the tuner housing by a user of the tuner applying hand force to the tuner bracket.

23. An electronic tuner for tuning a musical instrument as defined by claim 19, wherein at least one of the first and second lateral sidewalls of the tuner housing includes a raised surface formed thereon and situated on at least one side of at least one of the first and second grooves to help selectively retain the third protrusion within the at least one of the first and second grooves.

24. An electronic tuner for tuning a musical instrument as defined by claim 23, wherein the raised surface is in the form of an elongated U-shaped cup which resides on opposite sides of the at least one of the first and second grooves.

25. An electronic tuner for tuning a musical instrument as defined by claim 16, wherein each of the second protrusions is in the form of a cylindrical pin; and wherein the at least one first protrusion is in the form of an elongated rib.

26. An electronic tuner for tuning a musical instrument as defined by claim 25, wherein the tuner housing has an electrical socket for receiving an electrical plug, the electrical socket being mounted on at least one of the first and second lateral sidewalls of the tuner housing, the electrical socket having a width; and wherein the rib has a length which is at least equal to the width of the electrical socket.

27. An electronic tuner for tuning a musical instrument as defined by claim 17, wherein the tuner housing includes a display mounted on the front wall thereof; wherein the tuner bracket defines an open viewing area thereon; and wherein the open viewing area resides in overlying relationship with the display when the tuner bracket is in the first position with respect to the tuner housing.

28. An electronic tuner for tuning a musical instrument as defined by claim 18, wherein the tuner bracket is positionable on the tuner housing such that the second protrusions reside in corresponding first and second grooves of the tuner housing, and the first protrusion engages the back wall of the tuner housing, the tuner bracket acting as a stand to support the tuner housing at a particular angle defined between the back wall of the tuner housing and the tuner bracket.

29. An electronic tuner for tuning a musical instrument as defined by claim 28, wherein the particular angle defined between the tuner housing and the tuner bracket is between about 45 degrees and about 85 degrees.

30. An electronic tuner for tuning a musical instrument as defined by claim 28, wherein the particular angle defined between the tuner housing and tuner bracket is about 65 degrees.

* * * * *